US005510005A

United States Patent [19]

Gingerich

[11] Patent Number: 5,510,005

[45] Date of Patent: Apr. 23, 1996

[54] VENTURI HEADBOX FOR A PAPERMAKING MACHINE

[75] Inventor: Brian D. Gingerich, Covington, Va.

[73] Assignee: Westvaco Corporation, New York, N.Y.

[21] Appl. No.: 279,427

[22] Filed: Jul. 25, 1994

[51] Int. Cl.[6] ..... D21F 1/02

[52] U.S. Cl. ..... 162/343; 162/336

[58] Field of Search ..... 162/336, 343, 162/339, 340, 258, 259

[56] References Cited

U.S. PATENT DOCUMENTS

| | | | |
|---|---|---|---|
| 3,038,538 | 6/1962 | Logan et al. | 162/336 |
| 3,061,008 | 10/1962 | Walker . | |
| 3,597,818 | 8/1971 | Beck | 162/342 |
| 3,853,697 | 12/1974 | Parker et al. . | |
| 3,945,882 | 3/1976 | Egelhof et al. . | |
| 3,972,771 | 8/1976 | Notbohm . | |
| 4,104,116 | 8/1978 | Kaskimies | 162/343 |
| 4,298,429 | 11/1981 | Hergert et al. | 162/343 |
| 4,514,259 | 4/1985 | Koski . | |
| 4,604,164 | 8/1986 | Fujiwara et al. | 162/343 |
| 4,897,160 | 1/1990 | Wolf et al. . | |
| 4,898,643 | 2/1990 | Weisshuhn et al. . | |
| 4,906,336 | 3/1990 | Weisshuhn et al. . | |
| 5,110,416 | 5/1992 | Linsuri et al. . | |
| 5,298,126 | 3/1994 | Dahl . | |
| 5,304,285 | 4/1994 | Meinecke et al. . | |
| 5,316,383 | 5/1994 | Begemann et al. | 366/160 |

FOREIGN PATENT DOCUMENTS

| | | | |
|---|---|---|---|
| 462472 | 12/1991 | European Pat. Off. | 162/259 |
| 2658844 | 6/1978 | Germany | 162/343 |

OTHER PUBLICATIONS

Sushereba "Broad Selection of Headboxes . . . Papers" Paper Trade Journal Aug. 1964.

*Primary Examiner*—Karen M. Hastings
*Attorney, Agent, or Firm*—J. R. McDaniel; R. L. Schmalz

[57] ABSTRACT

This invention relates to headboxes which are used in papermaking machines. The inventive structure employs the use of a plurality of venturis located between the headbox chamber and the slice. Each venturi is located adjacent to a pulp conduit spaced transversely across the headbox chamber.

5 Claims, 2 Drawing Sheets

VENTURI HEADBOX FOR A PAPERMAKING MACHINE

BACKGROUND OF THE INVENTION

1. Field of the Invention

This invention relates to headboxes which are used in papermaking machines. Such structures of this type, generally, employ the use of a venturi located between the headbox and the slice.

2. Description of the Related Art

It is known, that the approach system to the headbox for papermaking machines makes use of a system which mixes the pulp and the white water such that the pulp and white water mixture is substantially homogeneous. Exemplary of such prior art are U.S. Pat. Nos. 3,061,008 to C. W. E. Walker, 3,945,882 to D. Egelhof et al., and 4,897,160 to K. Wolf et al. While these systems can produce a mixture of pulp and white water, due to the fact that the pulp and white water are mixed long before the mixture exits the slice, the randomness of the pulp fibers within the mixture is substantially decreased. If the randomness of the pulp fibers within the mixture is decreased, the cross direction (CD) strength properties of the paper produced by this mixture is adversely affected. Therefore, an advantageous headbox would be one which maintained the randomness of the pulp fibers within the pulp/white water mixture.

It is also known, in papermaking headboxes, to make use of an air pad that is located within the headbox. The air pad, along with the flow and consistency regulation of the pulp/white water mixture, are used to regulate the caliper and basis weight of the sheet formed by papermaking machines. Also, the slice opening can be used to regulate the basis weight and caliper of the formed sheet. However, because the basis weight control valve of the pulp/white water mixture is located at a distance from the area where the pulp/white water mixture is placed upon the forming screen, the operator must allow a certain amount of time between corrections in the operating parameters in order to regulate the formation of the sheet. Therefore, a more advantageous headbox would be one which would allow the operator to more quickly correct the operating parameters of the headbox during the formation of the sheet.

Finally, it is known in the art to make use of a series of rectifier rollers located within the headbox in order to adequately mix the pulp/white water mixture. While this system adequately mixes the pulp/white water mixture and produces a homogeneous mixture, this system suffers from several defects. In particular, as discussed earlier, this system, as flow rates change, allows the randomness of the pulp fibers within the mixture to become decreased. Also, this system allows flocculations to be formed in the mixture. If these flocculations are not removed from the mixture, the flocculations remain in the sheet while the sheet is being formed and adversely affect the quality of the sheet. Therefore, a still further advantageous system would be one which avoids the use of rollers and the formation of flocculations.

It is apparent from the above that there exists a need in the art for a headbox which is capable of producing a homogeneous mixture of pulp and white water, and which can be adjusted more quickly in response to changes in forming characteristics of the paper sheet, but which at the same time would allow the pulp fibers within the pulp/white water mixture to maintain their randomness within the mixture. It is the purpose of this invention to fulfill this and other needs in the art in a manner more apparent to the skilled artisan once given the following disclosure.

SUMMARY OF THE INVENTION

Generally speaking, this invention fulfills these needs by providing a venturi headbox for a papermaking machine, comprising a headbox, a pulp inlet means operatively connected to the headbox for delivering pulp to the headbox, a white water inlet means operatively connected to the headbox for delivering white water to the headbox, a venturi manifold means operatively connected to the headbox, and a slice means operatively connected to the venturi manifold means.

In certain preferred embodiments, the pulp inlet means includes a flow regulating valve and a recirculating tapered inlet header. Also, the white water inlet means includes a flow regulating valve and a recirculating tapered inlet header. Also, the headbox includes an air pad. Finally, the slice means includes an adjustable slice.

In another further preferred embodiment, the venturi headbox creates a homogeneous mixture of the pulp and the white water while allowing the pulp fibers within the mixture to remain in a substantially random condition. Also, the flow controls of the venturi headbox allow the operator to more precisely control the formation of the paper sheet.

The preferred venturi headbox, according to this invention, offers the following advantages: increased operating flow range; decreased flocculations; better formation of the sheet; increased randomness of the fiber orientation; increased basis weight control; increased caliper control; good stability; good durability; and good economy. In fact, in many of the preferred embodiments, these factors of increased operating flow range, decreased flocculations, better sheet formation, increased randomness of the fiber orientation, increased basis weight control and increased caliper control are optimized to an extent that is considerably higher than heretofore achieved in prior, known headboxes.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
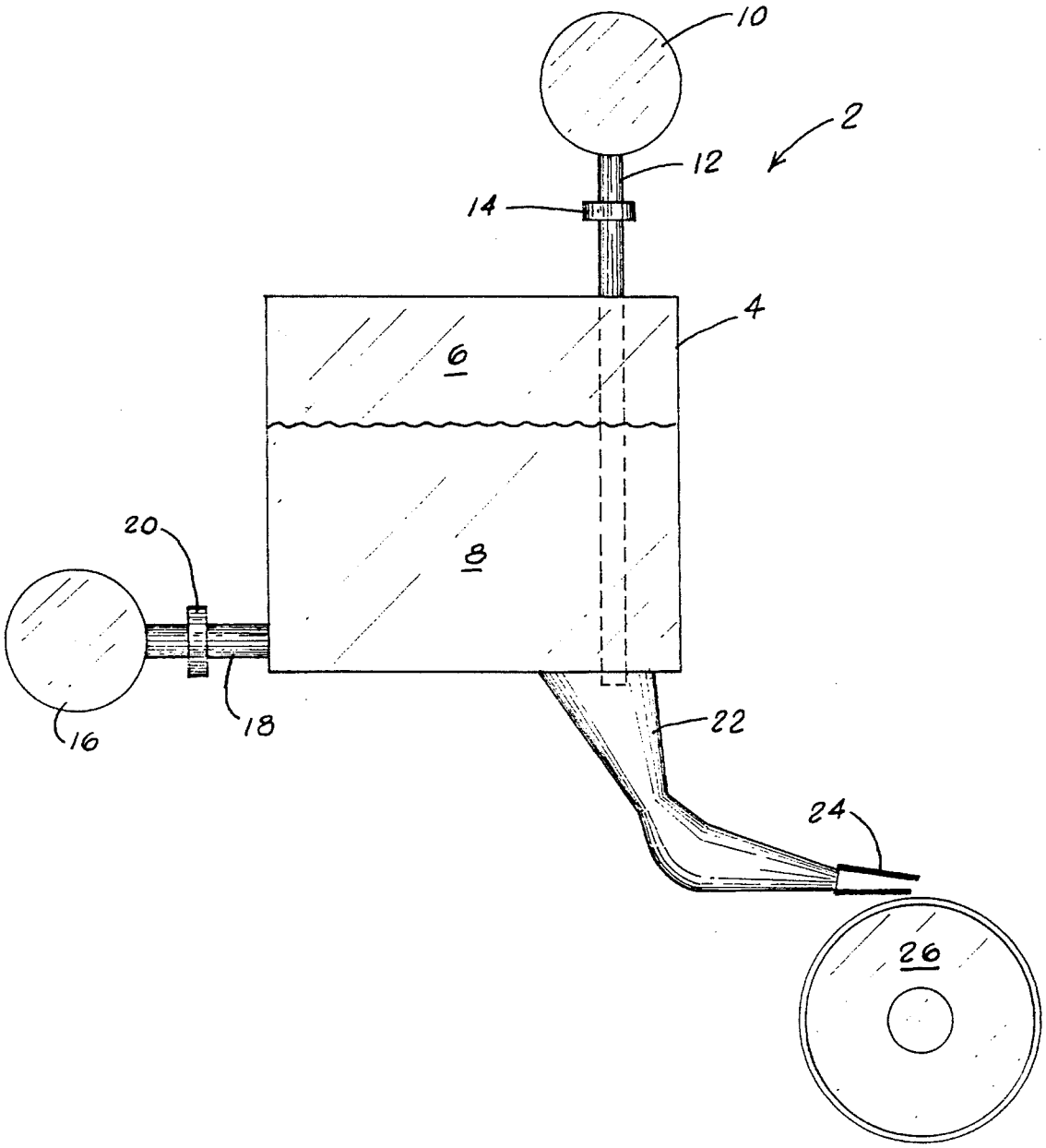
FIG. 1 is a side, schematic illustration of a venturi headbox, according to the present invention.

With reference first to FIG. 1, there is illustrated a venturi headbox 2. Headbox 2 includes, in part, headbox chamber 4, air pad 6, white water 8, pulp inlet 10, pulp inlet conduit 12, pulp flow regulating valve 14, white water inlet 16, white water conduit or "organ pipes" 18, white water flow regulating valve 20, venturi manifold 22, conventional adjustable slice 24, and conventional breast roll 26.

Figure 2:
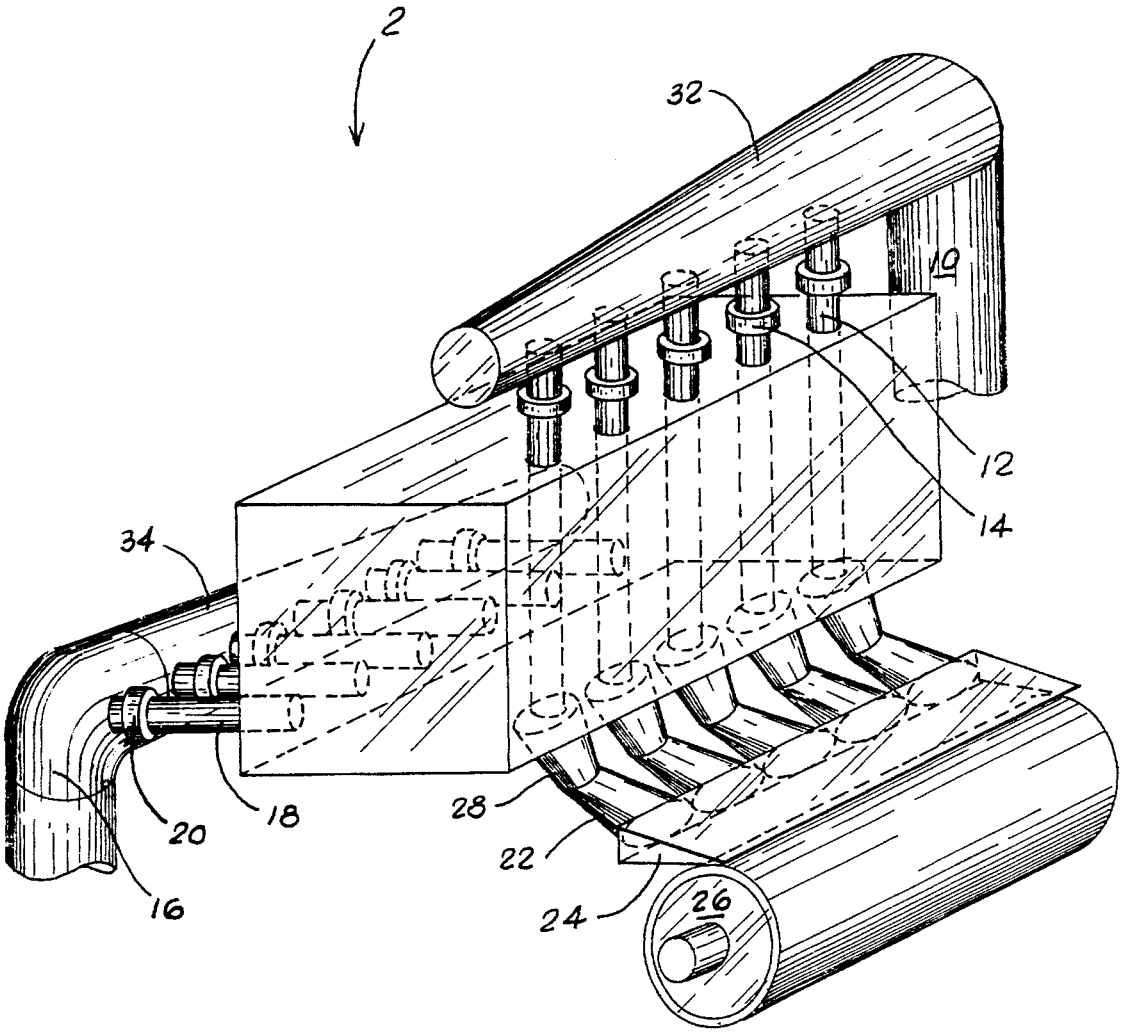
FIG. 2 is a perspective, schematic illustration of the venturi headbox, according to the present invention.

With respect to FIG. 2, venturi headbox 2 also includes, venturi 28, recirculating tapered pulp inlet header 32, and recirculating tapered white water inlet header 34.

During the operation of a venturi headbox 2, pulp is introduced into inlet 10 such that the pulp enters the recirculating paper pulp inlet header 32. At the same time, white water is introduced along inlet 16 through the recirculating tapered white water inlet header 34 to conduits 18.

As the pulp is translated along conduit 12 to headbox chamber 4, the white water is introduced into headbox chamber 4, too. As can be seen in FIG. 1, white water 8 is located within headbox chamber 4 such that an air pad 6 is also located within headbox chamber 4.

In this manner, as the pulp is being translated along conduit 12 to venturi manifold 22, white water 8 is also being introduced into venturi manifold 22. After the introduction of pulp into venturi manifold 22, in particular, in the area of venturi section 28, the pulp and white water are mixed by venturi 28 such that a homogeneous mixture of the pulp and white water is achieved. As can be seen in FIG. 2, the venturi manifold 22 has a plurality of venturis spaced transversely across the headbox chamber 4. Likwise the pulp conduit 12 is a plurality of pulp conduits spaced transversely across the headbox chamber 4, with a respective pulp conduit located adjacent to a respective venturi.

After the pulp and the white water are mixed in the venturi manifold 22, this mixture is translated to adjustable slice 24. After the pulp and white water mixtures leave adjustable slice 24, the mixture is placed upon breast roll 26 in order to began the formation of a paper or paperboard web (not shown).

It is to be understood that pulp flow regulating valve 14 and white water flow regulating valve 20 are used to control the flow of pulp and white water to headbox chamber 4, respectively. In this manner, the operator can quickly adjust the operating conditions of headbox 2, in order, to adjust the flow into headbox 2 to changes in the formation of a paperboard sheet on breast roll 26.

Venturi headbox 2 provides several advantages over the prior art. First, the operating flow range of headbox 2 is increased because the pulp flow rate and white water flow rate can be individually adjusted. Second, the headbox chamber 4 decreases flocculations formed in the raw stock on breast roll 26 because the pulp and white water, while homogeneously mixed in venturi manifold 22, do not have sufficient enough time to form flocculations within venturi manifold 22. Third, during the operation of venturi 28 within venturi manifold 22, the pulp and white water are homogeneously mixed and the orientation of the pulp fibers within the pulp and the white water is sufficiently random to allow for better fiber dispersal within a sheet that is formed upon breast roll 26. Fourth, due to the increased randomness of the fiber orientation within a web formed upon breast roll 26, there is less strength variability between the machine direction (MD) and the cross machine direction (CD). Fifth, headbox 2 allows for an increased basis weight control. This is because the pulp flow rate and white water flow rate can be individually controlled. Finally, the individual flow rate control of the pulp and the white water also increase the caliper control of the sheet being formed.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A venturi headbox for a papermaking machine, wherein said headbox is structured for having a pulp flowing from an upstream to a downstream direction and is comprised of:

a headbox chamber;

a pulp inlet means located upstream of said headbox chamber for delivering pulp to said headbox;

a white water inlet means located adjacent to said pulp inlet means for delivering white water to said headbox chamber;

a venturi manifold means having a plurality of venturis located downstream of and spaced transversely across said headbox chamber;

a slice means located downstream of said venturi manifold means; wherein said pulp inlet means is further comprised of:

a pulp flow regulating means located upstream of said headbox chamber;

a pulp header means located upstream of said pulp flow regulating means and said headbox chamber; and a pulp conduit means having a plurality of pulp conduits spaced transversely across said headbox chamber and operatively connected to said pulp header means, said pulp flow regulating means and said headbox chamber; and each venturi being located adjacent to a respective pulp conduit.

2. The venturi headbox, as in claim 1 wherein said pulp conduit means is located substantially within said headbox chamber.

3. The venturi headbox, as in claim 1, wherein said white water inlet means is further comprised of:

a white water flow regulating means located upstream of said headbox chamber;

a white water header means located upstream of said white water flow regulating means and said headbox chamber; and a white water conduit means operatively connected to said white water header means, said white water flow regulating means and said headbox chamber.

4. The venturi headbox, as in claim 1, wherein said slice means is further comprised of:

an adjustable slice means.

5. The venturi headbox, as in claim 1, wherein said white water inlet means is located a predetermined distance away from said pulp inlet means.

* * * * *